US006352616B1

(12) United States Patent
Dietz et al.

(10) Patent No.: US 6,352,616 B1
(45) Date of Patent: Mar. 5, 2002

(54) JOINTLESS LAMELLAE FOR A HEADBOX

(75) Inventors: Thomas Dietz, Königsbronn; Konstantin Fenkl, Rammingen, both of (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/602,873

(22) Filed: Jun. 28, 2000

(30) Foreign Application Priority Data

Jul. 2, 1999 (DE) ..... 199 30 592

(51) Int. Cl.[7] ..... D21F 1/02
(52) U.S. Cl. ..... 162/336; 162/341; 162/343
(58) Field of Search ..... 162/123, 216, 162/258, 259, 336, 341, 343, 212, 252, 253, 300, 301, 315, 344

(56) References Cited

U.S. PATENT DOCUMENTS

| | | | | |
|---|---|---|---|---|
| 3,888,729 A | | 6/1975 | Parker et al. | |
| 4,128,455 A | * | 12/1978 | Justus | 162/343 |
| 4,137,124 A | | 1/1979 | Bubik et al. | |
| 4,221,635 A | | 9/1980 | Kurtz et al. | |
| 4,566,945 A | | 1/1986 | Ewald et al. | |
| 4,941,950 A | | 7/1990 | Sanford | |
| 5,431,785 A | | 7/1995 | Bubik et al. | |
| 5,622,603 A | | 4/1997 | Begemann et al. | |

FOREIGN PATENT DOCUMENTS

| | | |
|---|---|---|
| AT | 361772 | 3/1981 |
| DE | 2240596 | 3/1973 |
| DE | 2623648 | 11/1977 |
| DE | 3047998 | 7/1982 |
| DE | 4225297 | 2/1994 |
| DE | 4307143 | 9/1994 |
| DE | 19652983 | 5/1997 |
| WO | 95/08023 | 3/1995 |
| WO | 98/50625 | 11/1998 |

* cited by examiner

*Primary Examiner*—Peter Chin
*Assistant Examiner*—Eric Hug
(74) *Attorney, Agent, or Firm*—Greenblum & Bernstein, P.L.C.

(57) ABSTRACT

Headbox that includes a turbulence generator including a plurality of essentially parallel rows of pipes and a jet including of an upper lip and a lower lip arranged to form a jet space and a jet outlet slit. A plurality of lamellae are arranged to subdivide the jet space, and the plurality of lamellae include end sections and lamella sections. The end sections are mounted between the plurality of essentially parallel rows of pipes, and at least some of the lamella sections are arranged to converge over a bend point in a direction of the jet outlet slit and, thereby, are angled toward a longitudinal axis of the turbulence generator.

36 Claims, 3 Drawing Sheets

JOINTLESS LAMELLAE FOR A HEADBOX

CROSS-REFERENCE TO RELATED APPLICATIONS

The present application claims priority under 35 U.S.C. §119 of German Patent Application No. 199 30 592.7, filed on Jul. 2, 1999, the disclosure of which is expressly incorporated by reference herein in its entirety.

BACKGROUND OF THE INVENTION

1. Field of the Invention

The invention concerns a headbox with a turbulence generator and a jet comprising an upper lip and a lower lip, whose interior space formed between the upper and the lower lip is subdivided by several lamellae.

2. Discussion of Background Information

Such a headbox is used for the production of a suspension stream, that is as wide as the machine, in a machine for the production of a material web. The material web formed from the suspension can especially be a paper or cardboard web.

In the headbox of this type known hitherto, the lamellae are generally designed to be rigid and jointed or flexible, and are fixed to special fittings which are provided between the rows of turbulence pipes. Headboxes with flexible lamellae are described, for example, in the publications DE 42 25 297 C2, DE-OS 22 40 596, and U.S. Pat. No. 4,566,945. These lamellae can freely adjust to the forces of the material stream flowing through. However, in headboxes known, for example, from the publications DE 43 07 143 C2 and U.S. Pat. No. 4,941,950 relatively rigid lamellae are provided which are connected to the turbulence generator by a joint. Flexible lamellae without joints float in the suspension so that their position in the jet space is determined by the prevailing hydraulic pressure relationship. The disadvantage here is that the lamellae are not free of bending stresses, in the position assumed during operation, because in headboxes with parallel positioning of the rows of turbulence pipes the mounting direction is not identical to the lamellae direction. The resultant restoring forces adversely affect the hydraulic relationship. Additionally, the durability of the lamellae is reduced by the bending stresses at the mounting point. Jointed lamellae entail a great overall height which is especially disadvantageous if a larger number of rows of pipes is necessary, e.g.,≧4. Greater overall heights are expensive and, for reasons of space, frequently also are not feasible without technological disadvantages.

SUMMARY OF THE INVENTION

It is the object of the invention to create an improved headbox of the type cited earlier in which the above mentioned disadvantages are eliminated. Achieved hereby, especially, shall be an inexpensive lamellae and turbulence generator arrangement with jointless lamellae.

This object is attained by the invention in that the turbulence generator comprises several at least essentially, parallel rows of pipes, in that the lamellae are mounted between the rows of pipes and converge in the direction of the jet outlet slit, while at least some of these lamellae within the jet area have course that deviate from the longitudinal axis of the turbulence generator, and in that the end sections of the lamellae that are mounted between the rows of pipes and parallel thereto each transition through a bend into a lamella section located inside the jet space, that is angled to the longitudinal axis of the turbulence generator.

Inexpensive production is possible, since the rows of pipes of the turbulence generator are, at least essentially parallel to one another. Also, this results in a low overall height in comparison to a swept back arrangement. The lamellae mounted between the rows of pipes insofar as they have a course within the joint area differing from the longitudinal axis of the turbulence generator, have a bend in the vicinity of the mounting point, by which the desired angle of each lamella section inside the jet area can be determined in advance. This makes it possible in particular for the angles of the lamella sections inside the jet space and predetermined by the particular bend to at least essentially correspond to the angles required for operation. Consequently, larger bending stresses no longer occur during operation.

Especially advantageous, as well, is that the lamellae can now be constructed without a joint.

In a preferred practical embodiment of the headbox according to the invention, the lamella sections located in the jet area have a course that is at least eventually straight.

The lamellae end preferably inside the jet.

In order to keep the overall height as low as possible, the thickness of the lamellae is preferably smaller than about 18 mm, especially in the area of the mounting point.

In a useful practical embodiment the bend angles of neighboring lamellae are different and are sized such that imaginary extensions of the lamellae and the jet lips intersect in one line.

According to the invention the bend angles have values between about 0° and 20°, preferably between about 0° and 12°.

It is also advantageous when, viewed in the z-direction of the headbox, the bend angles of those lamellae attached a distance away from the axis have greater values than the lamellae attached closer to the axis.

When the lamellae in the jet area are attached symmetrically, it is advantageous if the bend angles of two symmetrically positioned lamellae have the same value.

Further, it is advantageous when the lamellae are made of carbon fiber laminate, glass fiber reinforced plastic and/or polycarbonate, e.g., such as Makrolon®, Lexan® and/or similar.

It is advantageous to provide at least one lamella, that is one-pieced, bent, and cut from the solid.

According to a preferred practical embodiment of the headbox according to the invention, however, at least one two-pieced lamella can also be provided, whose two parts are glued together. Here, the glue joint is most usefully positioned in the vicinity of the lamella section mounted between the rows of pipes.

In one preferred embodiment the glue joint is located completely outside of and—in the direction of flow—in front of the jet area adjacent to the turbulence generator. Thus the glued surfaces are not exposed to any aggressive paper suspension and protected accordingly. With the glue joint located outside of the jet area, the glued surfaces are also outside of the lamella area in which limited bending stress can still occur, thereby achieving greater durability.

The two parts of the lamella can be glued together by flat glue surfaces, or by glued surfaces that are shaped in complementary fashion so as to interlock.

In one advantageous embodiment of the headbox according to the invention the two parts of the lamella are glued together by glued surfaces that run generally diagonally to the longitudinal extent of the relevant lamella section, when viewed in cross-section. If the glue joint is provided, again, in the area of the lamella section between the rows of pipes, the angle of the diagonal glued surfaces can be selected in reference to the angle of the section of the relevant lamella located in the jet space.

In one preferred practical embodiment the diagonal glued surfaces of each lamella are at least approximately parallel to the orientation of the lamella section located inside the jet area. An overall beneficial bending and bonding stress is achieved with such diagonal glued surfaces.

The two lamella parts glued together can additionally be bolted.

In one preferred practical embodiment the lamellae are manufactured with formed bends.

It is also advantageous when the lamellae are attached to the turbulence generator, or respectively its pipes, in an interlocking manner. In this case it can be useful when the lamella sections mounted between the rows of pipes are provided with transverse grooves, which advantageously engage ribs or projections provided on the pipes of the turbulence generator.

It is advantageous when at least some of the lamellae can be removed from the side.

In general, it is also possible for at least some of the lamellae or lamella sections located in the jet space to be mounted with a bayonet fastener and to be removable in the direction of the machine.

Two-piece lamellae with a bayonet fastener are already known from DE 196 52 983 A1.

The present invention is directed to a headbox that includes a turbulence generator including a plurality of essentially parallel rows of pipes and a jet including of an upper lip and a lower lip arranged to form a jet space and a jet outlet slit. A plurality of lamellae are arranged to subdivide the jet space, and the plurality of lamellae include end sections and lamella sections. The end sections are mounted between the plurality of essentially parallel rows of pipes, and at least some of the lamella sections are arranged to converge over a bend point in a direction of the jet outlet slit and, thereby, are angled toward a longitudinal axis of the turbulence generator.

According to a feature of the invention, the angle of the lamella sections located inside the jet space may correspond at least essentially to an angle required for operation.

In accordance with another feature of the invention, the plurality of lamellae may each be formed without a joint.

According to still another feature of the present invention, the lamella sections located in the jet space can have an essentially straight course when viewed in cross-section.

In accordance with a further feature of the instant invention, the plurality of lamellae can have ends which are located within the jet space.

A thickness of the plurality of lamellae can be smaller than about 18 mm, and, in particular, the thickness of the plurality of lamellae in a mounting area can be smaller than about 18 mm.

Further, bend angles of neighboring lamellae may be different and the lamellae may be sized such that imaginary extensions of each lamella, the upper lip, and the lower lip are arranged to intersect at a common line. The bend angles may be between about 0° and 20°, and, preferably, the bend angles are between approximately 0° and 12°. When viewed in a z-direction of the headbox, the bend angles of the lamellae mounted a distance away from the longitudinal axis may have higher values than the lamellae mounted closer to longitudinal axis.

In accordance with another feature of the invention, the lamellae in the jet space can be symmetrically mounted and bend angles of two lamellae symmetrically mounted to one another can have a same value.

The lamellae may include at least one of carbon fiber laminate, glass fiber reinforce plastic, and polycarbonate. Further, the polycarbonate can include at least one of Makrolon® and Lexan®.

According to another feature of the invention, at least one lamella may include a single piece element with a bent portion.

In accordance with still another feature of the present invention, at least one lamella may include a two-pieced lamella having two pieces which are glued together. Further, a glued joint can be located in the end section and can be mounted between the plurality of rows of pipes. A glue joint can be located completely outside of the jet space. Still further, a glue joint may be located upstream of the jet space, relative to a flow direction, and adjacent to the turbulence generator. The two pieces of the two-pieced lamella can include flat glue surfaces which are glued together. Further still, the two pieces of the two-pieced lamella can include complementary shapes adapted to interlock. The two pieces of the two-pieced lamella may include surfaces that are generally diagonal to a longitudinal extent of the relevant lamella section. A glue joint can be located in the area of the end section, and an angle of the diagonal glue surfaces can be a function of an angle of the lamella section in the jet space. The diagonal glued surfaces may be at least almost parallel to an orientation of the lamella sections.

Moreover, the two pieces of the two-pieced lamella can be additionally bolted together.

According to a further feature of the invention, the plurality of lamellae may be formed with integral bend points.

In accordance with a still farther feature of the instant invention, the plurality of lamellae can be interlockingly connected with the turbulence generator.

The plurality of lamellae may be interlockingly connected with the plurality of rows of pipes. Further, the end sections can include transverse grooves, and the plurality of pipes can include one of ribs and projections. The grooves may be adapted to engage the one of ribs and projections.

According to still another feature of the invention, at least some of the plurality of lamellae can be removed laterally from a side of the turbulence generator.

Further, bayonet fasteners can be included. At least some of the plurality of lamellae may be mounted by the bayonet fasteners so as to be removable in a flow direction.

The present invention is directed to a headbox that includes a turbulence generator, a jet comprising an upper lip and a lower lip arranged to form a jet space and a jet outlet slit, and a plurality of lamellae. Each lamella includes a lamella end coupled to the turbulence generator, a lamella section located within the jet space, and a bend region. The bend region is located between the end section and the lamella section.

In accordance with a feature of the invention, the turbulence generator may include a plurality of substantially parallel rows of pipes, and the lamellae may be located between adjacent rows. The lamella sections may be arranged to converge in a direction of the jet outlet slit.

According to another feature of the present invention, the lamellae may be arranged to subdivide the jet space. The lamellae may be arranged to substantially equally subdivide the jet space.

In accordance with still another feature of the instant invention, the lamellae may be arranged substantially symmetrically to the jet outlet slit. A longitudinal extent of each lamellae may converge to a common line. The common line may be located downstream, relative to a flow direction, of the jet outlet slit.

The end sections may include first and second parts coupled together. The first and second parts can be coupled together with glue. Further, the first and second parts can be coupled together with bolts, In accordance with yet another feature of the present invention, the end sections can include transverse grooves, and the plurality of pipes include one of ribs and projections. The grooves may be adapted to engage the one of ribs and projections.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
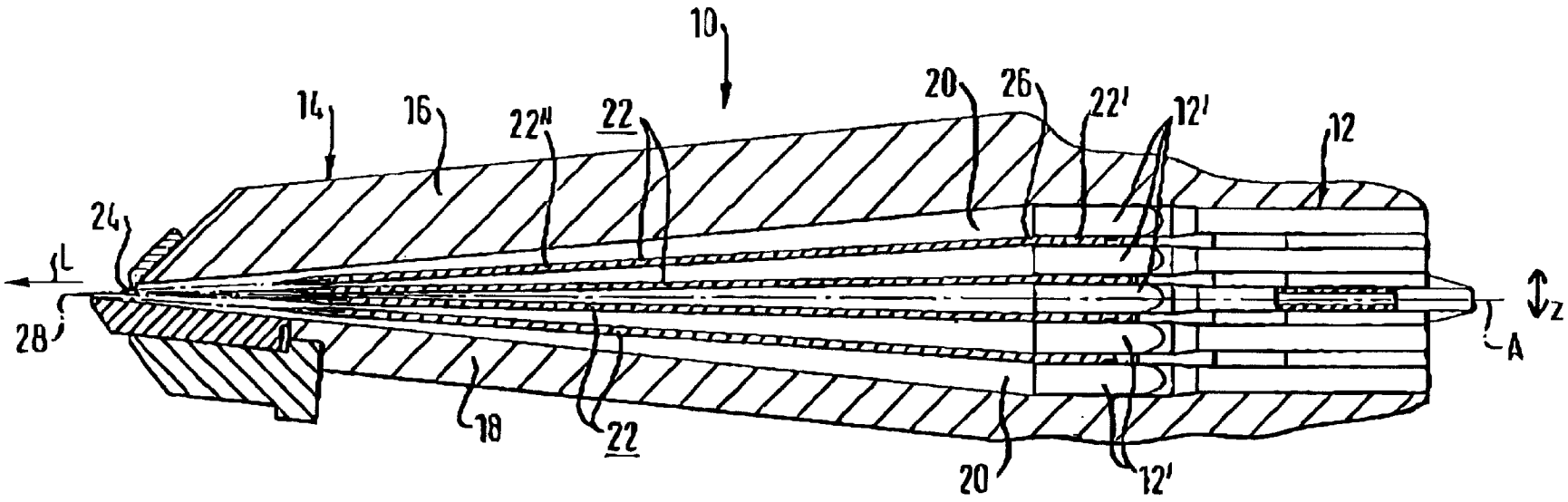
FIG. 1 a schematic partially sectioned side view of a section of the headbox.
Figure 2:
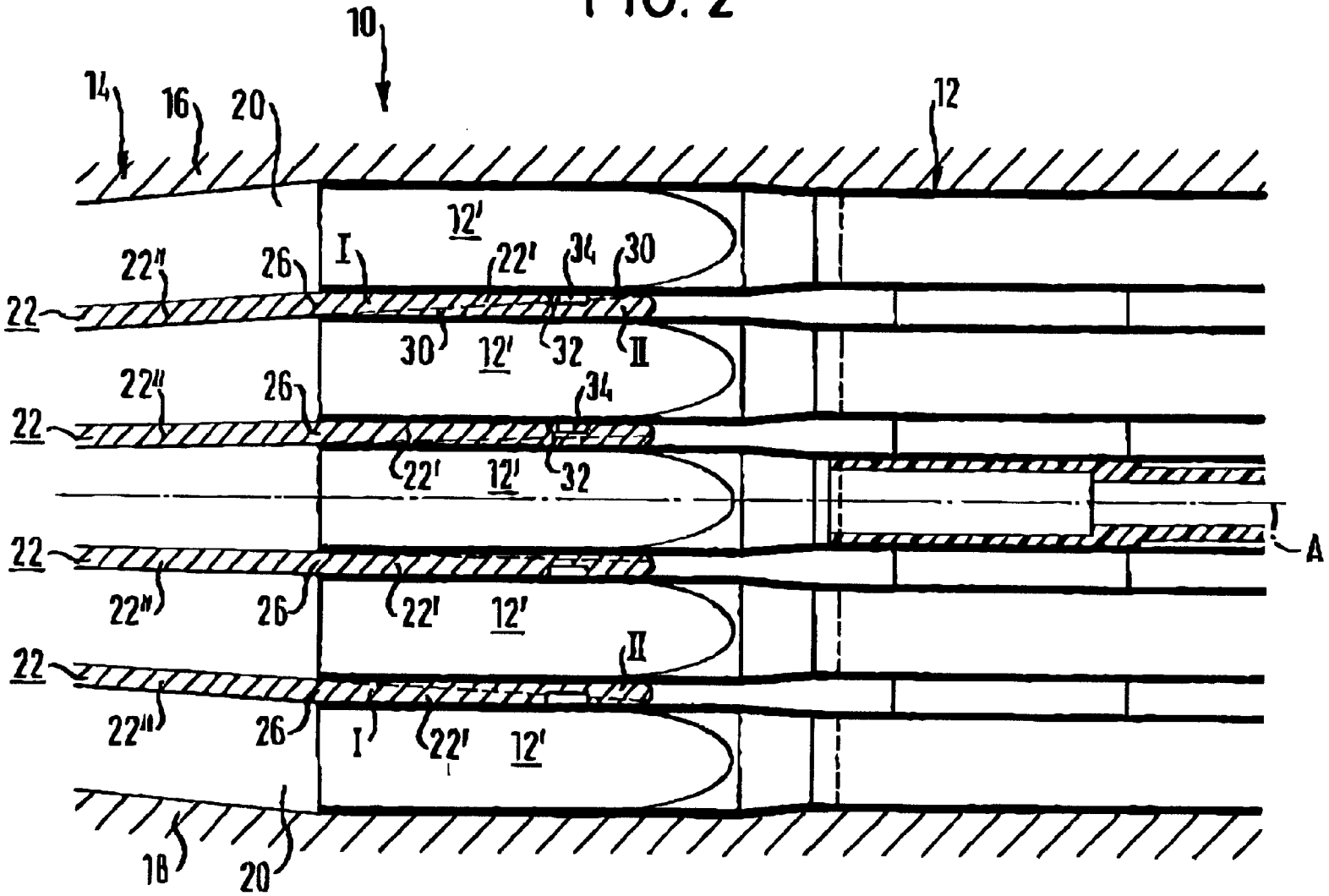
FIG. 2 an enlarged schematic representation of the lamella mounting areas of the headbox shown in FIG. 1.
Figure 3:
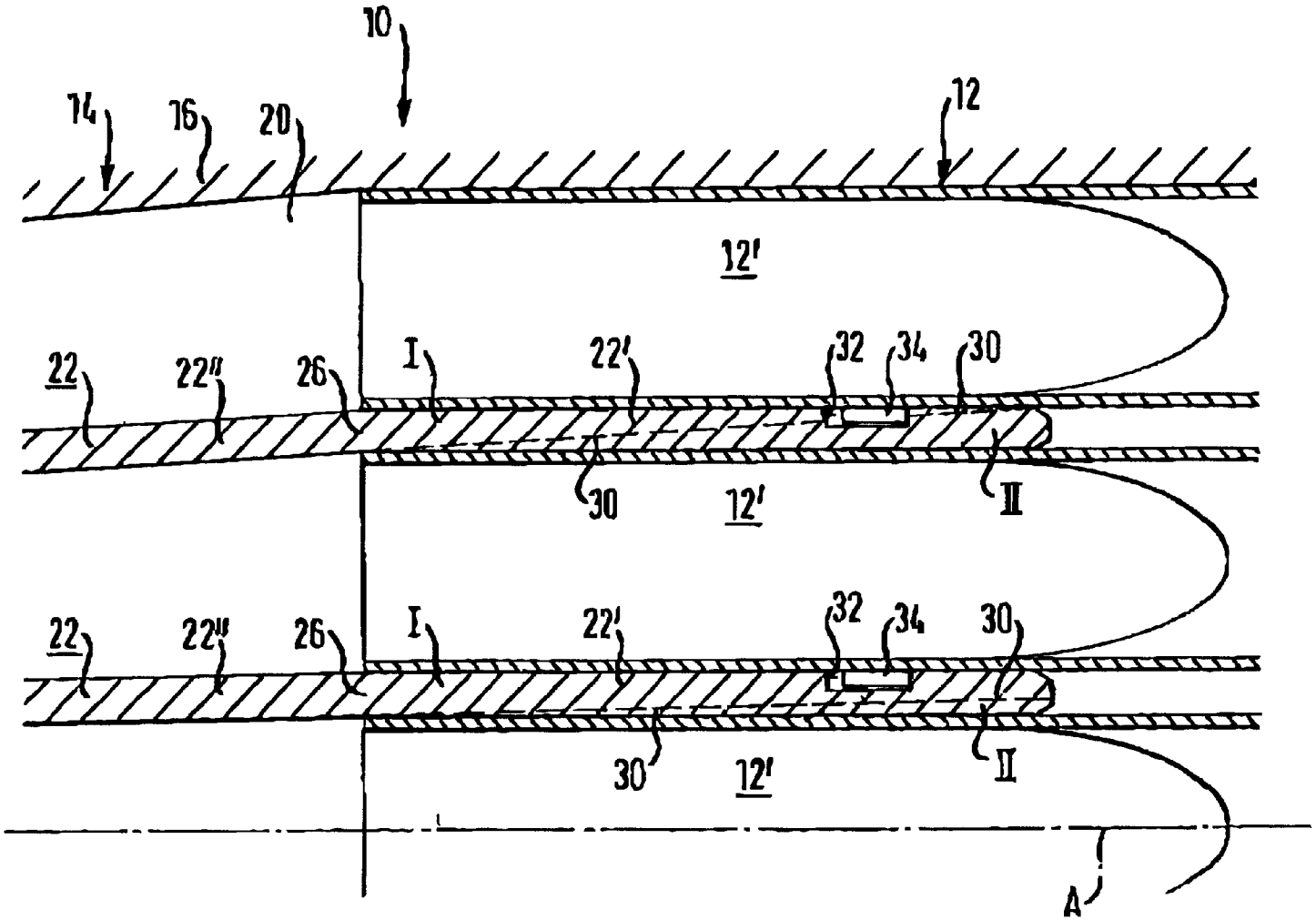
FIG. 3 a further enlarged schematic representation of the two upper lamella mounting areas of the headbox.

The headbox 10 depicted in FIGS. 1 through 3 comprises a turbulence generator 12 as well as a jet 14 which is provided with an upper lip 16 and a lower lip 18 between which is formed an inner or jet space 20 that guides a material suspension. The jet space 20 is subdivided by several lamellae 22.

The turbulence generator 12 comprises several at least essentially parallel rows of pipes 12'. The lamellae 22 are mounted between these rows of pipes 12'. In the present example embodiment there are four lamellae 22 provided.

As can best be observed in FIG. 1 the lamellae 22 converge in the direction of the jet outlet slit 24 in that they have a course deviating from the longitudinal axis A of the turbulence generator 12 inside of the jet area 20. In this context the end sections 22' of the lamellae 22 that are mounted parallel to and between the rows of pipes 12', each transition through bend point 26 into a lamella section 22", that is angled to the axis A of the turbulence generator 12, and located in the jet space 20.

In the present example embodiment the lamella sections 22" of the two upper lamellae 22 are angled downward to the jet outlet slit 24 and the lamella sections 22" of the two lower lamellae 22 are angled upward. Here, the angle of the lamella sections 22" of the relevant lamellae 22 located in the jet area 20, predetermined by the relevant bend point 26, corresponds, at least essentially, with the angle required for operation.

The lamellae 22 are therefore designed without a joint.

In the present example embodiment the lamellae sections 22" located in the jet area 20 have an at least essentially straight course viewed in cross-section. As can be seen in FIG. 1 the lamellae 22 end inside the jet 14.

The thickness of the lamellae 22 is preferably smaller than about 18 mm, especially in the area of the mounting point.

As it is especially clear in FIG. 2 and FIG. 3 the bend angles formed between the end sections 22' and the lamella sections 22" of neighboring lamellae 22 are different, and are sized such that the imaginary extensions of the lamellae 22 and the jet lips 16, 18 intersect in a transverse line 28. This intersection line 28 is situated outside of the jet 14 as shown in FIG. 1.

The bend angles of the lamellae 22 assume values between about 0° and 20°, preferably between about 0° and 12°, where it can also be seen in FIG. 1 that, viewed in the z-direction of the headbox 10, the bend angles of the lamellae 22 attached a distance from the longitudinal axis A have higher values than the lamellae 22 attached closer to the longitudinal axis A. Furthermore, the lamellae 22 in the jet area 20 are mounted symmetrically so that the bend angles or two lamellae 22 mounted symmetrically to one another beneficially have the same value.

The lamellae 22 can be made, e.g., from carbon fiber laminate, glass fiber reinforced plastic, and/or polycarbonate such as, e.g., Makrolon®, Lexan® and/or similar.

In the present exemplary embodiment two-pieced lamellae 22 are provided whose two parts I, II (compare FIG. 3) are glued to each other. The glue joints are provided in the area of the lamella sections 22' mounted between the rows of pipes 12', where they are positioned completely outside of and, in the direction of flow L, in front of, the jet space 20 adjacent to the turbulence generator 12.

In the present exemplary embodiment the two lamella parts I, II of each lamella 22 are glued together by flat glued surfaces 30 (compare FIGS. 2 and FIGS. 3). As is especially clear in FIG. 2 and FIG. 3 the glued surfaces 30 of the two lamella parts I, II of each lamella 22 run generally diagonal to the longitudinal extent of the relevant lamella section 22' when viewed in cross-section, i.e., diagonal to the longitudinal axis A of the turbulence generator 12.

The angle of the diagonal glued surfaces 30 in the present case is dependent on the angle of the section 22" of the relevant lamella 22, located in the jet space 20. Here, these diagonal glued surfaces 30 can be, at least almost, parallel to the orientation of the relevant lamella section 22", located in the jet area 20.

The two lamella parts I, II glued to one another (compare FIGS. 2 and FIGS. 3) of each lamella 22 can additionally be bolted.

The lamellae 22 are preferably manufactured with integrated bend points 26. In this case the bend points are already made during the production process.

As is especially clear in FIG. 3 the lamellae 22 can be attached to the turbulence generator 12, resp. its row of pipes 12' in interlocking manner. Thus in the present exemplary embodiment the lamella sections 22' mounted between the rows of pipes 12' are provided with transverse grooves 32 which engage ribs or projections 34 that preferably are provided on the rows of pipes 12' of the turbulence generator 12.

In the present exemplary embodiment the lamellae 22 can be removed laterally from the side.

In general, however, lamellae provided with bayonet fasteners that can be taken off in the direction of the machine are also possible.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

LIST OF REFERENCE CHARACTERS

10 Headbox
12 Turbulence generator
12' Rows of pipes
14 Jet
16 Upper lip
18 Lower lip
20 Jet area
22 Lamellae
22' Lamella sections
22" Lamella sections
24 Jet outlet slit
26 Bend points
28 Intersection line
30 Glued surfaces
32 Transverse grooves
34 Ribs or projections
A Longitudinal axis
L Direction of flow
z z-direction
I Part
II Part

What is claimed:

1. A headbox comprising:

a turbulence generator comprising a plurality of essentially parallel rows of pipes;

a jet comprising of an upper lip and a lower lip arranged to form a jet space and a jet outlet slit;

a plurality of lamellae arranged to subdivide said jet space;

said plurality of lamellae comprising end sections and lamella sections;

said end sections being mounted between said plurality of essentially parallel rows of pipes; and at least some of said lamella sections being arranged to converge over a bend point in a direction of said jet outlet slit and, thereby, being angled toward a longitudinal axis of said turbulence generator, wherein said end sections comprise first and second parts coupled together.

2. The headbox in accordance with claim 1, wherein the angle of said lamella sections located inside said jet space corresponds at least essentially to an angle required for operation.

3. The headbox in accordance with claim 1, wherein said plurality of lamellae are each formed without a joint.

4. The headbox in accordance with claim 1, wherein said lamella sections located in said jet space have an essentially straight course when viewed in cross-section.

5. The headbox in accordance with claim 1, wherein said plurality of lamellae have ends which are located within said jet space.

6. The headbox in accordance with claim 1, wherein a thickness of said plurality of lamellae is smaller than about 18 mm.

7. The headbox in accordance with claim 6, wherein the thickness of said plurality of lamellae in a mounting area is smaller than about 18 mm.

8. The headbox in accordance with claim 1, wherein bend angles of neighboring lamellae are different and said lamellae are sized such that imaginary extensions of each lamella, said upper lip, and said lower lip are arranged to intersect at a common line.

9. The headbox in accordance with claim 8, wherein said bend angles are between about 0° and 20°.

10. The headbox in accordance with claim 9, wherein said bend angles are between approximately 0° and 12°.

11. The headbox in accordance with claim 8, wherein, when viewed in a z-direction of said headbox, said bend angles of said lamellae mounted a distance away from the longitudinal axis have higher values than said lamellae mounted closer to longitudinal axis.

12. The headbox in accordance with claim 1, wherein said lamellae in said jet space are symmetrically mounted and bend angles of two lamellae symmetrically mounted to one another have a same value.

13. The headbox in accordance with claim 1, wherein said lamellae comprises at least one of carbon fiber laminate, glass fiber reinforce plastic, and polycarbonate.

14. The headbox in accordance with claim 1, wherein at least one lamella comprises a single piece element with a bent portion.

15. The headbox in accordance with claim 1, wherein at least one lamella comprises a two-pieced lamella having two pieces which are glued together.

16. The headbox in accordance with claim 15, wherein said two pieces of said two-pieced lamella comprises flat glue surfaces which are glued together.

17. The headbox in accordance with claim 1, wherein said plurality of lamellae are interlockingly connected with said turbulence generator.

18. The headbox in accordance with claim 1, wherein said plurality of lamellae are interlockingly connected with said plurality of rows of pipes.

19. The headbox in accordance with claim 1, wherein at least some of said plurality of lamellae can be removed laterally from a side of said turbulence generator.

20. The headbox in accordance with claim 1, further comprising bayonet fasteners, wherein at least some of said plurality of lamellae are mounted by said bayonet fasteners so as to be removable in a flow direction.

21. A headbox comprising:

a turbulence generator comprising a plurality of essentially parallel rows of pipes;

a jet comprising of an upper lip and a lower lip arranged to form a jet space and a jet outlet slit;

a plurality of lamellae arranged to subdivide said jet space;

said plurality of lamellae comprising end sections and lamella sections;

said end sections comprising first and second parts coupled together, which are mounted between said plurality of essentially parallel rows of pipes; and at least some of said lamella sections being arranged to converge over a bend point in a direction of said jet outlet slit and, thereby, being angled toward a longitudinal axis of said turbulence generator, wherein said lamellae comprises at least one of carbon fiber laminate, glass fiber reinforce plastic, and polycarbonate, and wherein said polycarbonate comprises high tech polycarbonate.

22. The headbox in accordance with claim 21, wherein said high tech polycarbonate comprises at least one of Makrolon® and Lexan®.

23. A headbox comprising:

a turbulence generator comprising a plurality of essentially parallel rows of pipes;

a jet comprising of an upper lip and a lower lip arranged to form a jet space and a jet outlet slit;

a plurality of lamellae arranged to subdivide said jet space;

said plurality of lamellae comprising end sections and lamella sections;

said end sections being mounted between said plurality of essentially parallel rows of pipes; and at least some of said lamella sections being arranged to converge over a bend point in a direction of said jet outlet slit and, thereby, being angled toward a longitudinal axis of said turbulence generator, wherein at least one lamella comprises a two-pieced lamella having two pieces which are glued together, and wherein a glued joint is located in said end section and is mounted between said plurality of rows of pipes.

24. A headbox comprising:

a turbulence generator comprising a plurality of essentially parallel rows of pipes;

a jet comprising of an upper lip and a lower lip arranged to form a jet space and a jet outlet slit;

a plurality of lamellae arranged to subdivide said jet space;

said plurality of lamellae comprising end sections and lamella sections;

said end sections being mounted between said plurality of essentially parallel rows of pipes; and at least some of said lamella sections being arranged to converge over a bend point in a direction of said jet outlet slit and, thereby, being angled toward a longitudinal axis of said turbulence generator, wherein at least one lamella comprises a two-pieced lamella having two pieces which are glued together, and wherein a glue joint is located completely outside of said jet space.

25. A headbox comprising:

a turbulence generator comprising a plurality of essentially parallel rows of pipes;

a jet comprising of an upper lip and a lower lip arranged to form a jet space and a jet outlet slit;

a plurality of lamellae arranged to subdivide said jet space;

said plurality of lamellae comprising end sections and lamella sections;

said end sections being mounted between said plurality of essentially parallel rows of pipes; and at least some of said lamella sections being arranged to converge over a bend point in a direction of said jet outlet slit and, thereby, being angled toward a longitudinal axis of said turbulence generator, wherein at least one lamella comprises a two-pieced lamella having two pieces which are glued together, and wherein a glue joint is located upstream of said jet space, relative to a flow direction, and adjacent to said turbulence generator.

26. A headbox comprising:

a turbulence generator comprising a plurality of essentially parallel rows of pipes;

a jet comprising of an upper lip and a lower lip arranged to form a jet space and a jet outlet slit;

a plurality of lamellae arranged to subdivide said jet space;

said plurality of lamellae comprising end sections and lamella sections;

said end sections being mounted between said plurality of essentially parallel rows of pipes; and at least some of said lamella sections being arranged to converge over a bend point in a direction of said jet outlet slit and, thereby, being angled toward a longitudinal axis of said turbulence generator, wherein at least one lamella comprises a two-pieced lamella having two pieces which are glued together, and wherein said two pieces of said two-pieced lamella comprises complementary shapes adapted to interlock.

27. A headbox comprising:

a turbulence generator comprising a plurality of essentially parallel rows of pipes;

a jet comprising of an upper lip and a lower lip arranged to form a jet space and a jet outlet slit;

a plurality of lamellae arranged to subdivide said jet space;

said plurality of lamellae comprising end sections and lamella sections;

said end sections being mounted between said plurality of essentially parallel rows of pipes; and at least some of said lamella sections being arranged to converge over a bend point in a direction of said jet outlet slit and, thereby, being angled toward a longitudinal axis of said turbulence generator, wherein at least one lamella comprises a two-pieced lamella having two pieces which are glued together, and wherein said two pieces of said two-pieced lamella comprises surfaces that are generally diagonal to a longitudinal extent of said relevant lamella section.

28. The headbox in accordance with claim 27, wherein a glue joint is located in the area of said end section, and an angle of said diagonal glue surfaces is a function of an angle of said lamella section in said jet space.

29. The headbox in accordance with claim 28, wherein said diagonal glued surfaces are at least almost parallel to an orientation of said lamella sections.

30. A headbox comprising:

a turbulence generator comprising a plurality of essentially parallel rows of pipes;

a jet comprising of an upper lip and a lower lip arranged to form a jet space and a jet outlet slit;

a plurality of lamellae arranged to subdivide said jet space;

said plurality of lamellae comprising end sections and lamella sections;

said end sections being mounted between said plurality of essentially parallel rows of pipes; and at least some of said lamella sections being arranged to converge over a bend point in a direction of said jet outlet slit and, thereby, being angled toward a longitudinal axis of said turbulence generator, wherein at least one lamella comprises a two-pieced lamella having two pieces which are glued together, and wherein said two pieces of said two-pieced lamella are additionally bolted together.

31. A headbox comprising:

a turbulence generator comprising a plurality of essentially parallel rows of pipes;

a jet comprising of an upper lip and a lower lip arranged to form a jet space and a jet outlet slit;

a plurality of lamellae arranged to subdivide said jet space;

said plurality of lamellae comprising end sections and lamella sections;

said end sections comprising first and second parts coupled together, which are mounted between said plurality of essentially parallel rows of pipes; and at least some of said lamella sections being arranged to converge over a bend point in a direction of said jet outlet slit and, thereby, being angled toward a longitudinal axis of said turbulence generator, wherein said plurality of lamellae are formed with integral bend points, and said plurality of lamellae comprise at least one of carbon fiber laminate, glass fiber reinforce plastic, and polycarbonate comprising high tech polycarbonate.

32. A headbox comprising:

a turbulence generator comprising a plurality of essentially parallel rows of pipes;

a jet comprising of an upper lip and a lower lip arranged to form a jet space and a jet outlet slit;

a plurality of lamellae arranged to subdivide said jet space;

said plurality of lamellae comprising end sections and lamella sections;

said end sections being mounted between said plurality of essentially parallel rows of pipes; and at least some of said lamella sections being arranged to converge over a bend point in a direction of said jet outlet slit and, thereby, being angled toward a longitudinal axis of said turbulence generator, wherein said plurality of lamellae are interlockingly connected with said plurality of rows of pipes, wherein said end sections comprise transverse grooves, and said plurality of pipes include one of ribs and projections, and wherein said grooves are adapted to engage said one of ribs and projections.

33. A headbox comprising:

a turbulence generator;

a jet comprising an upper lip and a lower lip arranged to form a jet space and a jet outlet slit; and a plurality of lamellae, each lamella comprising a lamella end coupled to said turbulence generator, a lamella section located within said jet space, and a bend region, wherein said bend region is located between said end section and said lamella section, and wherein said end sections comprise first and second parts coupled together.

34. The headbox in accordance with claim 33, wherein said first and second parts are coupled together with glue.

35. The headbox in accordance with claim 34, wherein said first and second parts are coupled together with bolts.

36. A headbox comprising:

a turbulence generator;

a jet comprising an upper lip and a lower lip arranged to form a jet space and a jet outlet slit; and a plurality of lamellae, each lamella comprising a lamella end coupled to said turbulence generator, a lamella section located within said jet space, and a bend region, wherein said bend region is located between said end section and said lamella section, wherein said end sections comprise transverse grooves, and said plurality of pipes include one of ribs and projections, and wherein said grooves are adapted to engage said one of ribs and projections.

* * * * *